United States Patent [19]

Groetschel

[11] 4,358,159

[45] Nov. 9, 1982

[54] APPARATUS FOR SUPPORTING THE ROOF OF AN UNDERGROUND MINE WORKING

[76] Inventor: Karl M. Groetschel, Montsalvatstrasse 1a, D-8000 Munich 40, Fed. Rep. of Germany

[21] Appl. No.: 204,941

[22] Filed: Nov. 7, 1980

[30] Foreign Application Priority Data

Nov. 8, 1979 [DE] Fed. Rep. of Germany ..... 2945082

[51] Int. Cl.[3] ..... E21D 9/04; E21D 9/10

[52] U.S. Cl. ..... 299/33; 405/150; 405/296; 299/11; 299/45

[58] Field of Search ..... 299/11, 33, 45; 405/288, 296, 150

[56] References Cited

U.S. PATENT DOCUMENTS

| | | | |
|---|---|---|---|
| 3,399,927 | 9/1968 | Groetschel | 299/11 |
| 4,099,785 | 7/1978 | Groetschel | 299/33 X |
| 4,122,682 | 10/1978 | Groetschel | 299/33 X |
| 4,230,371 | 10/1980 | Bell et al. | 299/33 |
| 4,263,005 | 4/1981 | Sigott et al. | 405/150 X |

FOREIGN PATENT DOCUMENTS

| | | | |
|---|---|---|---|
| 2529675 | 1/1977 | Fed. Rep. of Germany | 299/33 |
| 2015622 | 9/1979 | United Kingdom . | |

*Primary Examiner*—Ernest R. Purser

*Attorney, Agent, or Firm*—Spencer & Kaye

[57] ABSTRACT

Apparatus for use in supporting the roof of an underground mine working over a zone exposed by the passage of a mining machine along an upwardly extending face of the working and by which a flexible mat is applied to the roof which has been newly exposed, such apparatus comprising an applicator means for applying a strip of flexible roof mat drawn off from a store in a position such that it extends with its length running longitudinally of the newly exposed zone, means for releasably mounting said applicator means in an operative position of use on said mining machine and transfer means for moving said applicator means out of said position of use at such times as are required to a further position. The further position may be a position of rest where the applicator apparatus is inactive or it may be a second position of use in which the applicator means is disposed behind same or a further cutting element of the mining machine during traverse of that machine in a direction reversely of that for which the first position of use of the applicator means was appropriate. The transfer means may be in the form of a jib arm which can be moved angularly in horizontal and vertical planes and such jib arm may be provided with gripping means for handling parts of the machine or ancilliary members as well as, or alternatively to, the applicator means.

19 Claims, 15 Drawing Figures

4
5
130
60
100
1a
1b
b

P
P'
2
3
4
5
130
100
60
60'
1
1a
1b a
b
c
2
3
4
5
100
130
60
1

APPARATUS FOR SUPPORTING THE ROOF OF AN UNDERGROUND MINE WORKING

BACKGROUND OF THE INVENTION

This invention relates to apparatus for use in supporting the roof of an underground mine working over a zone exposed by the passage of a mining machine along an upright face of the working, and by which a flexible mat is applied to the roof which has been newly exposed and is fixed thereto.

The invention has been developed primarily in relation to the requirement to support the roof of an underground coal mine working in which coal is mined by the method of long wall coal mining and the mining machine is a coal winning machine.

In my U.S. Pat. No. 4,099,785 I describe apparatus for applying a flexible mat to the roof of an underground mine working in which a directing means for applying the mat has an operative connection with a means providing a controlling output representing the height of the roof, such that the height of the directing means is controlled in accordance with roof height.

In one such arrangement the operative connection is established by mounting the directing means on a scraper or clearer plate sometimes known as a shield plate or cowl which itself is mounted coaxially with a cutting cylinder of the mining machine.

Preferably the directing means is detachably mounted in contrast with a permanent connection. Such a detachable connection, whether on the cowl or on some other part of the machine, allows the mat directing means to be disconnected at any desired time so that it does not obstruct or otherwise impede a 180° reversal of the member on which the mat directing means is carried, necessary whenever the mining machine reverses direction.

The directing means may form part of a mat applicator with accessory devices such as a device for stapling the laid matting strips together.

One of the problems encountered with such an arrangement is that each time the mining machine is reversed in direction at the limits of travel, the mat applicator and other accessories have to be disconnected from the support member and then reconnected, all of which can take a considerable length of time. Furthermore in particular when the machine is inclined to the horizontal, such operations can be difficult, and personnel operating the machine can be exposed to hazards.

It is therefore an object of the present invention to provide an apparatus that overcomes or reduces the above mentioned problems.

A further object of the invention is to provide a form of mining machine which can be brought readily into and out of service when component parts are required to be replaced, notwithstanding that they may be difficult to manhandle and when supplementary appliances such as mat applicator means, mined material deflecting means such as shield plate, or other appliances such as props are required to be moved, whether for the purpose of installing them on the machine or removing them therefrom, or otherwise handling them.

SUMMARY OF THE INVENTION

According to one aspect of the present invention, I provide in a mining machine comprising a body movable in forward and reverse direction of traverse along and adjacent to an upstanding face from which material is to be removed in a mining operation, a cutting element on said body for removing said material and thereby creating a succession of newly exposed elongate roof zones requiring support, and applicator means for applying strips of flexible roof mat, drawn off from a store, in respective positions such that said strips extend with their lengths running longitudinally of respective ones of said newly exposed roof zones, the improvement comprising a. means for releasably mounting said applicator means in an operative position of use on said mining machine, b. transfer means for moving said applicator means between said position of use and a further position spaced from said position of use.

The further position may be a position of rest spaced laterally of the direction of traverse of the machine and away from the face, and the applicator means may be inactive or may be capable of being rendered inactive when occupying the position of rest. Apparatus of this form would be suitable when the machine includes a single cutter element which is traversed in a forward direction along the face of the cutter element in a raised position and is subsequently traversed in the reverse direction with the cutter element in the lower position for the purpose of removing a lower strip of material from the face. The mat application operation would require to be carried out only during the first or forward traverse and the mat applicator means may, therefore, be moved into its position of rest at the end of the forward traverse and may remain in this position during the reverse traverse.

Alternatively the further position may be the second position of use in which the applicator means is disposed behind and adjacent to the same or a further cutting element during traverse of the machine in a direction reversely of that for which the first position of use of the applicator means would be appropriate. This arrangement would be suitable for a machine having two cutter elements, one of which is brought into use during forward traverse and the other of which is brought into use during reversed traverse of the machine. The mat applicator means would then be transferred from association with that one of the cutter elements operative during the forward traverse to that one of the cutter elements operative during the reverse traverse, such transfer being effected at the end of the forward traverse and before the beginning of the reverse traverse. Alternatively the arrangement would be suitable for use with a machine having a single cutter element which is operative during both directions of traverse and in which the mat applicator means is required to be moved from a position behind the cutter element during forward traverse to a position behind the cutter element during reverse traverse.

According to a further aspect of the invention there is provided a mining machine for use in long wall coal mining and comprising a body, a cutting element supported from the body for removing coal from an upright face as the machine is traversed therealong, characterised by the provision on the machine of a lifting means for handling movable or removable parts of the machine or other members in use in the vicinity thereof.

Preferably the lifting means would include a base means mounted non-tiltably on the body of the machine and a head means formed, constructed or provided with means for operating with the part or member to be handled.

The lifting means may thus be used in servicing the mining machine and reduces the time and manual effort necessary in lifting parts on and off the machine.

BRIEF DESCRIPTION OF THE DRAWINGS

The invention will now be described with reference to examples of embodiments illustrated in the accompanying drawings wherein.

DESCRIPTION OF THE PREFERRED EMBODIMENT

Figure 3:
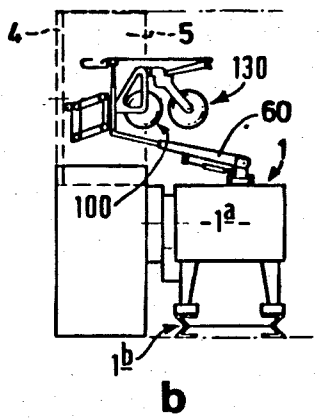
FIG. 3 is a view of the embodiment shown in FIG. 1 in end elevation looking in the direction of the dotted arrow P' and showing the applicator means in an intermediate position between the two cutting cylinders.
Figure 1:
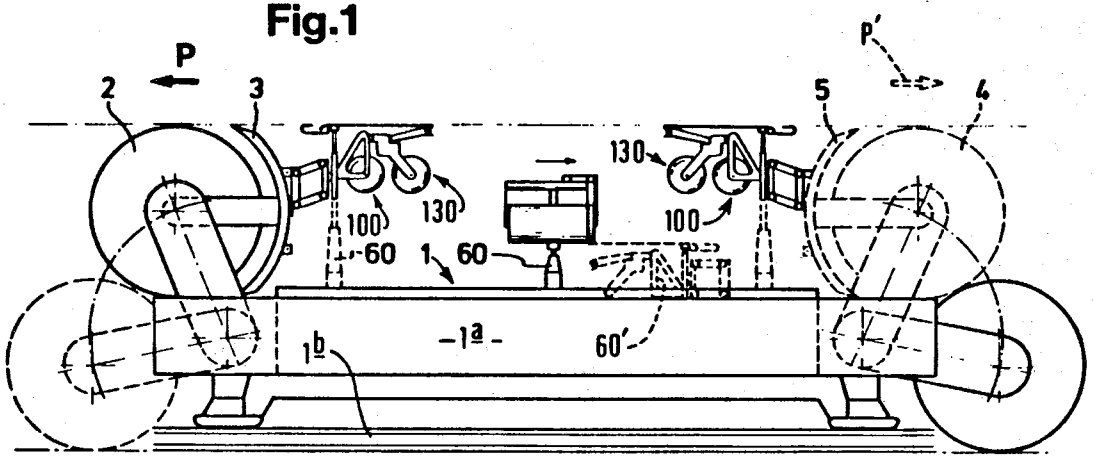
FIG. 1 is a schematic view in side elevation of one embodiment of the invention applied to a twin-cylinder coal cutting machine.
Figure 2:
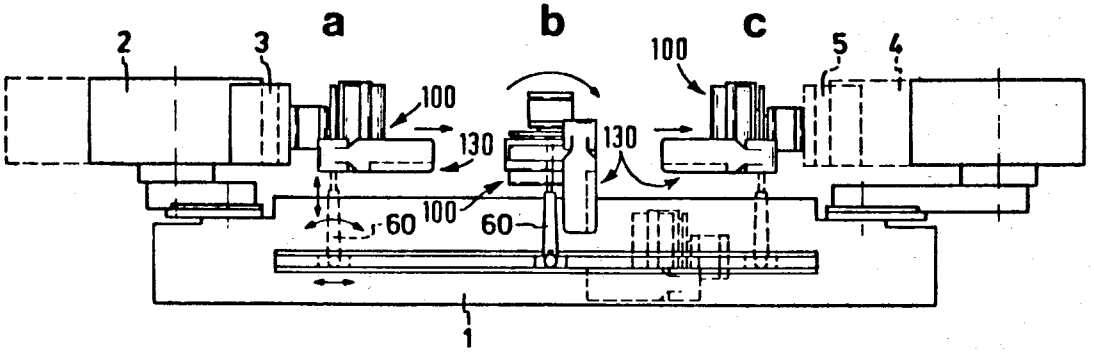
FIG. 2 is a schematic top view of the embodiment shown in FIG. 1.

As shown in the schematic drawings of FIGS. 1 to 3, a twin-cylinder machine 1 comprising a body 1*a* mounted on a trackway 1*b* and having two cutting cylinders 2, 4, can be traversed in forward and reversed directions shown respectively by arrows P, P' along and adjacent to an upwardly extending face of a mine working such as a long wall coal mine working. When traversed forwardly the active cylinder 2 having a shield plate 3 is in a raised position while the inactive cylinder 4 and the shield plate 5 is lowered all as shown in full lines, whereas during traverse in the reverse direction P' the positions of these cylinders and shield plates are as shown in broken lines.

Figure 4:
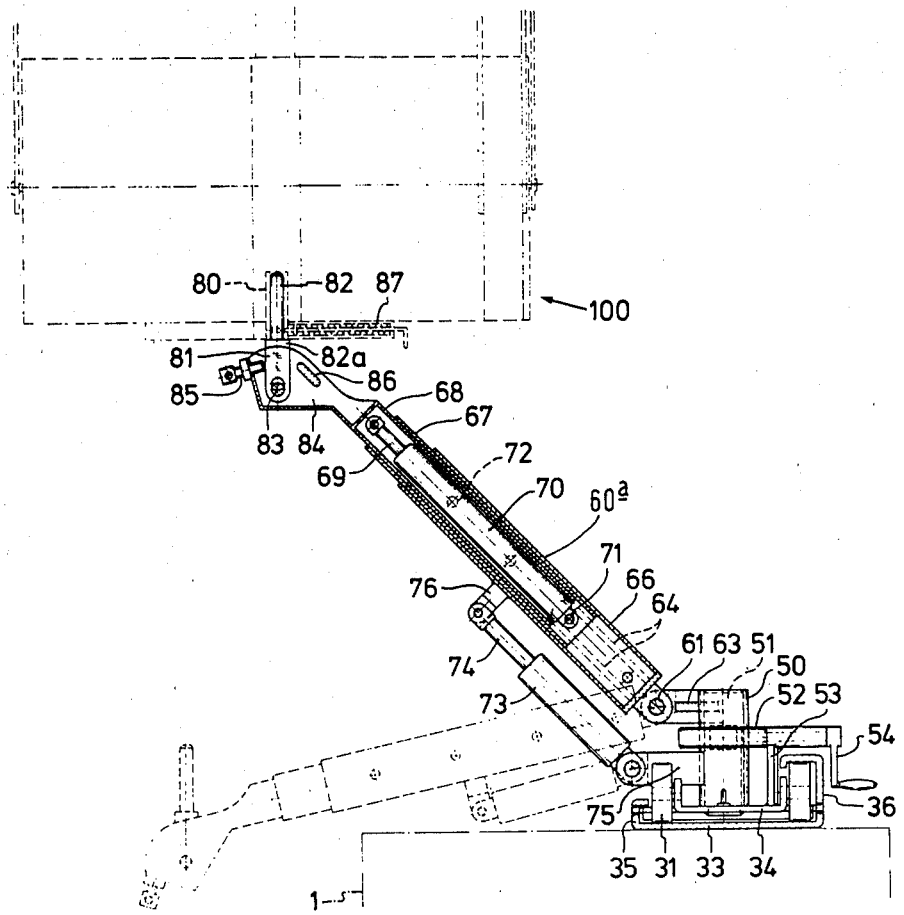
FIG. 4 is a fragmentary view in end elevation and on a larger scale showing the lifting means.
Figure 5:
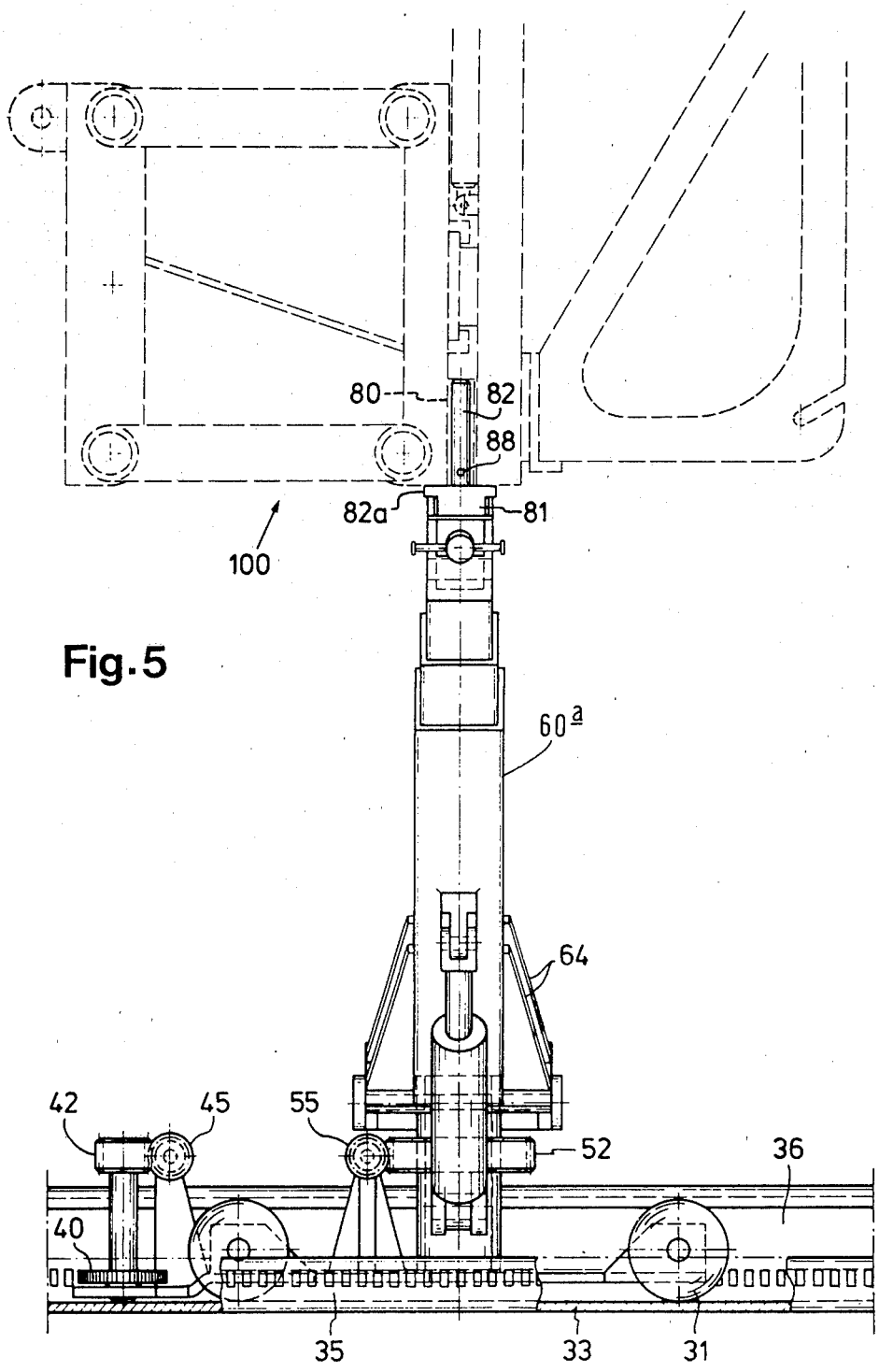
FIG. 5 is fragmentary view in elevation of the lifting means.
Figure 6:
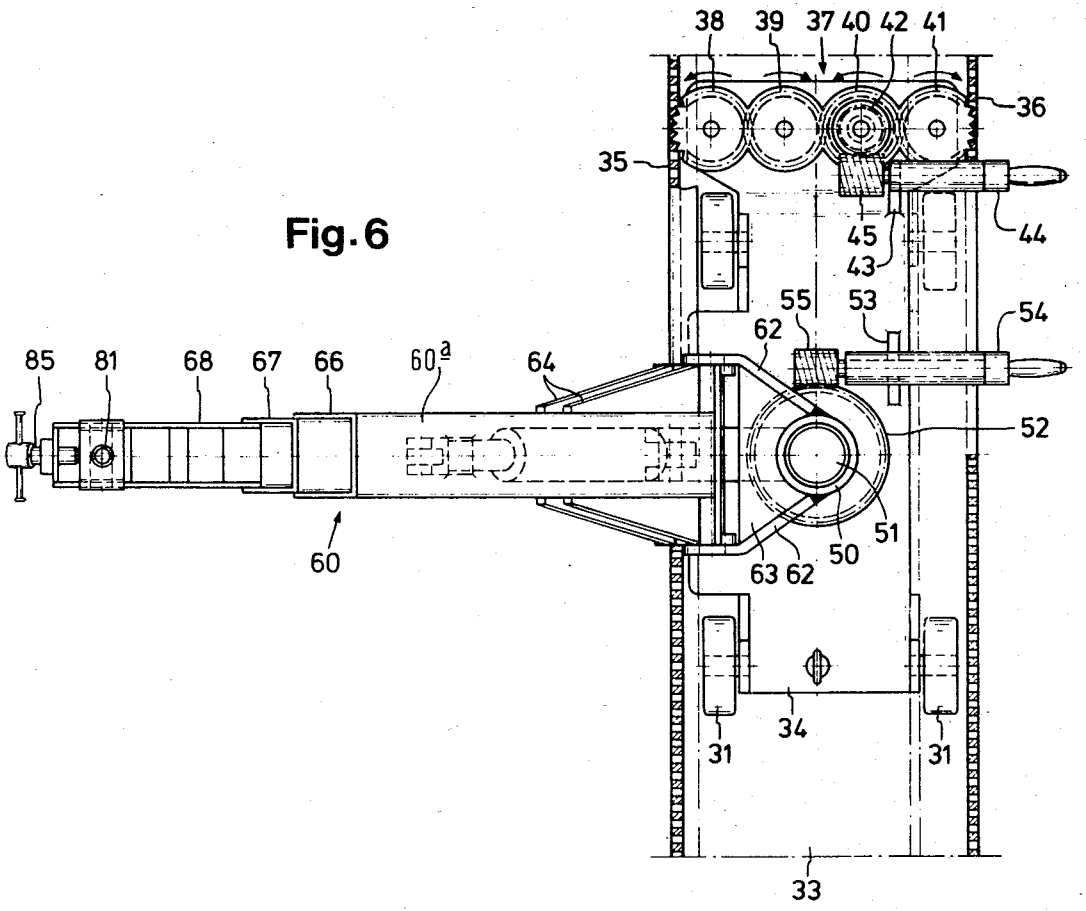
FIG. 6 is a fragmentary view in plan of the lifting means in working position.

In order to illustrate the functions of the associated lifting device, shown in detail in FIGS. 4, 5 and 6, the mat applicator means, generally designated 100 (and in the illustrated example an associated mat stapler device 130), are represented in three different positions a, b, c. For convenience reference is made only to the applicator means in describing the operations except where specific reference to the fastening means is necessary.

Position a shows the mat applicator means mounted on the shield plate 3 of the active cutting cylinder 2 but already seized by arm, shown in broken lines, of a lifting means 60. In an intermediate position b, (shown specifically in FIG. 3), the mat applicator means has been removed from the shield plate 3 and is supported by the lifting means in a partially lowered position in which it has been horizontally turned or pivoted relatively to the arm through 90° so that, after a second 90° turn, and perhaps an intervening storage stage in a rest position on the machine indicated in broken lines at 60', it can be brought into position c in which it is mounted on the shield plate 5 preparatory to the associated cylinder 4 coming into action during reverse traverse.

The transfer of the applicator means on the twin-cylinder machine shown in FIGS. 1, 2 and 3 between several positions is effected by the lifting means 60.

Figure 8A:
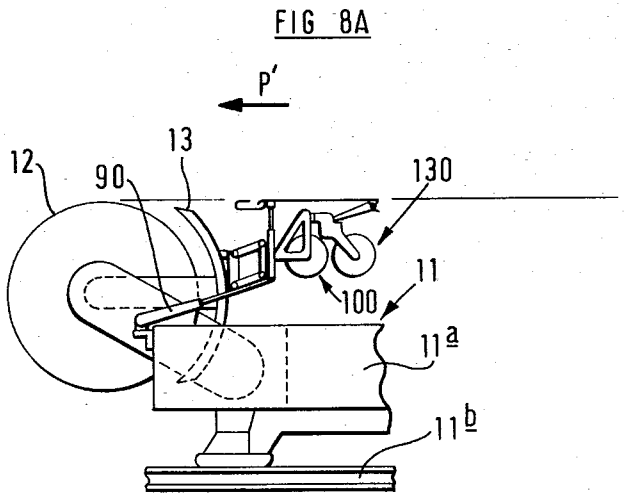
FIG. 8A is a fragmentary view similar to FIG. 7 but showing the shield plate and applicator means transferred to a further position of use relatively to the cutting cylinder of the machine.
Figure 9:
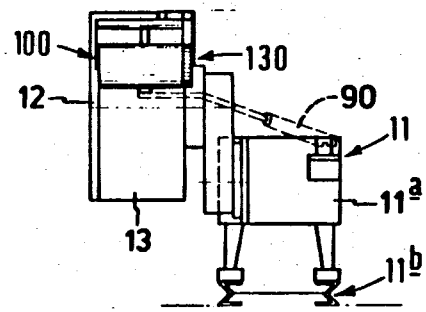
FIG. 9 is a view in end elevation of the embodiment shown in FIG. 7 viewed in the direction of the arrow P.
Figure 7:
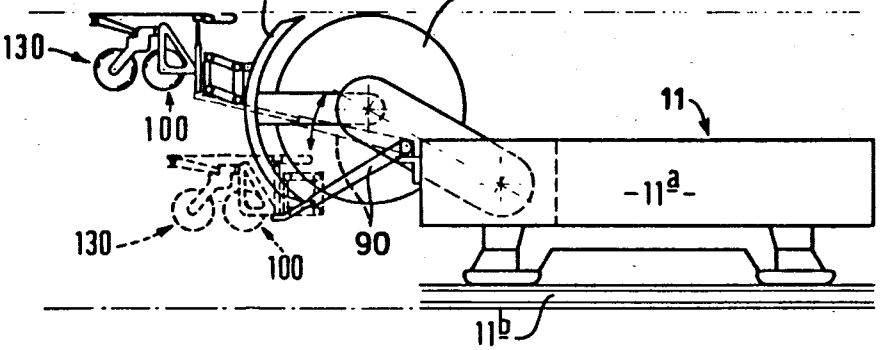
FIG. 7 is a schematic view in side elevation of a further embodiment of the invention as applied to a single-cylinder cutting machine.
Figure 8:
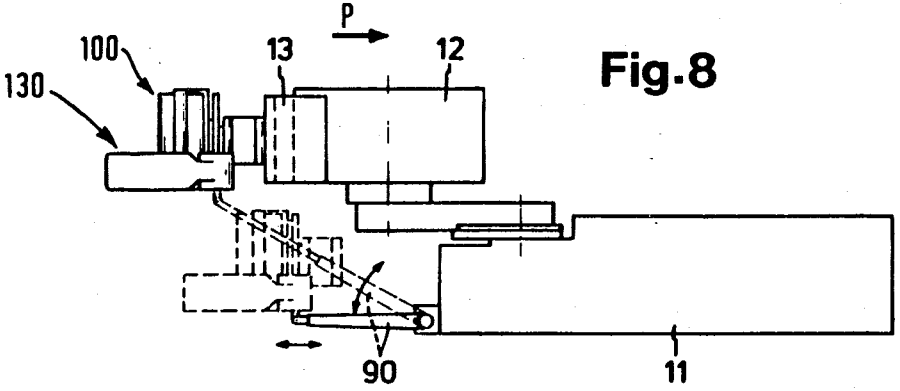
FIG. 8 is a plan view of the embodiment shown in FIG. 7, the broken lines representing the mat applicator means in an operative position.

In the embodiment shown in FIGS. 7, 8 and 9, is shown a coal cutting machine 11 also having a body 11*a* mounted on a trackway 11*b* along which it can be traversed in forward and reverse directions P1, P', and one cutting cylinder 12. The first operation required at the end of a forward cutting traverse in the direction of arrow P during which a top region of the upstanding face has been cut back, is to remove the mat applicator means 100, 130 from the shield plate 13 and to turn it in a horizontal plane out of the cutting field so that the shield plate itself can be turned unobstructedly in a vertical plane through 180° into a new working position at the trailing side of the cylinder 12 for reverse traverse of the machine. In the course of this traverse, the remaining bottom section of the coal face may be cut back and in this case no mat laying need take place. Thus the applicator means is brought into an inoperative position of rest, and remains in this position until it is once more needed, such that it will in no way obstruct operations or be itself exposed to damage as regards any part thereof. Both these requirements can be satisfied with the aid of the lifting means 90, as clearly shown in FIGS. 7, 8 and 9 which depict the various operative positions of the lifting means. The latter also shown schematically may be in the form of a hydraulic manipulated arm. In some cases, as shown in FIG. 8A where the single cylinder machine cuts at the same level in both forward and reversed traverses, the applicator means would be removed from the shield plate after the forward traverse, and then restored to mounting on the shield plate after the latter had been repositioned at the trailing side of the cutter and before effecting reversed traverse in the direction shown by arrow P1. The fastening means would be adjusted laterally in position so that it operated along the proximate margins of the last applied and newly applied strips of matting.

The embodiment shown in FIGS. 4, 5 and 6 is of a transfer means in the form of a lifting means suitable for the single or twin cylinder machines. It includes a foot plate 34 provided with four skid rollers 31 and is guided thereby non-tiltably in a guideway 33 fixed on the coal cutting machine 1 parallel with the coal face. By means of a set of gear wheels 37, meshing with rack bars or perforation strips rigidly mounted on the plate 34 and forming the lateral walls 35, 36 of the guideway channel 33, the lifting means can be moved therealong. The gear wheels 37 can be driven manually through a wormdrive with very little manual effort. The set of gear wheels 37 comprises four gear wheels 38, 39, 40, 41 arranged in line on the foot plate 34 transversely of the guideway 33, the two outside gear wheels 38, 41 meshing with the associated ones of the rack bars or strips provided on or by walls 35, 36, and one of the inner gear wheels namely 40 having a driven connection with a wormwheel 42 which is in mesh with the worm 45. The worm is rotatable by a spindle supported by a bearing or bracket strip 43 upstanding from the plate 34 and provided with a hand crank 44.

The wormdrive 42,45 has a suitable gear ratio to transmit drive to the gears 38,39,40,41 and provide for self locking and hence controllability of movements of the lifting means along the guideway 33 effected by the operating personnel. By virtue of its self-locking action, it ensures, even in steeply inclined workings, that the lifting means remains immovable unless the hand crank 44 is operated.

With the same degree of controllability, the arm **60*a* of the lifting means 60 and which is carried by a hub 50, is also secured against unwanted turning or pivotal displacement about the vertical spindle which latter is rigid on the foot plate 34. Controlled swivelling about the spindle is effected by means of another self locking wormdrive. This comprises a wormwheel 52 fixed on the hub 50 and a worm 55 fixed on a spindle journalled in a bearing carried by a bracket 53 on a footplate 34. This spindle is driven by a hand crank (possibly also by a motor), and the wormdrive reliably prevents all undesired, accidental pivotal displacements of the lifting device which might otherwise be caused by even minor deviations of the coal cutting machine from a strictly horizontal position. The necessary lateral rigidity of the articulated joint between the lifting arm 60*a* and the hub 50 is provided, for example as shown in FIGS. 5 and 6, by the comparatively long length of the hinge bolt 61 as well as by the stiffening web plate 63 between the arms 62 fixed to the hub 50 and gusset plates 64** on the lifting arm itself.

The lifting arm **60*a*, of which the length can be adjusted partly hydraulically and partly by a change-over of component parts, comprises three telescopically slidable tubular sections 66, 67, 68 which are of square cross-sectional configuration to impart the required torsional rigidity to the lifting arm as a whole. The innermost tube 68 is connected with the piston 69 and the middle tube 67 with the cylinder 70 of a piston and cylinder unit which effects a continuous steplessly variable length adjustment. A pivot bolt 71 which connects the cylinder 70 with the tube 67 is suitably extended and also anchors the tube 67 in the outer tube 66. To this end four holes such as are indicated at 72 are provided in the side walls of the outer tube 66** so that there are three different starting points or steps available from which steplessly variable hydraulic length adjustment can begin.

The lifting arm **60*a* is raised and dropped by means of the piston and cylinder unit whereof the cylinder 73 is secured via lug 75 to the hub 50, and the piston 74 via lug 76 to the outer tube 66**. Locking or retaining means in the case of the piston and cylinder units may comprise valve means acting as a hydraulic lock.

The head or top piece 84 of the lifting arm **60*a* is adapted to engage with and hold mat-applicator means during removal from and installation on the shield plate by mounting means in the form of a coupling mechanism. In the illustrated embodiment this comprises complementary cooperative parts, namely a coupling box or socket 80 arranged on the underside of the applicator means 100 and a male coupling element 81. The latter comprises a bolt 82 which engages in the socket, and which has laterally projecting shoulders 82*a* which engage circularly rounded edges of the lateral walls of the head piece 84 at the free end of the telescopic tube 68 and which conveniently is made of channel-shape in transverse vertical cross-section. The coupling element 81 is supported by the rounded channel edges, and is pivotable about a hinge bolt 83 with which the circularly rounded edges are coaxial. The possible pivotal displacement of coupling element 81 can be adjusted, e.g. by means of a set screw 85 and a cotter element 86 (FIG. 4) as to limits of travel to suit local requirements. Uncontrolled turning of the applicator means 100 about the coupling bolt 82 when the applicator means has been disconnected from the shield plate is prevented by a spring bolt 87 which is arranged on the lower part of the applicator means and clicks into one of the recesses 88 provided for this purpose on the coupling element 81**.

Figure 10A:
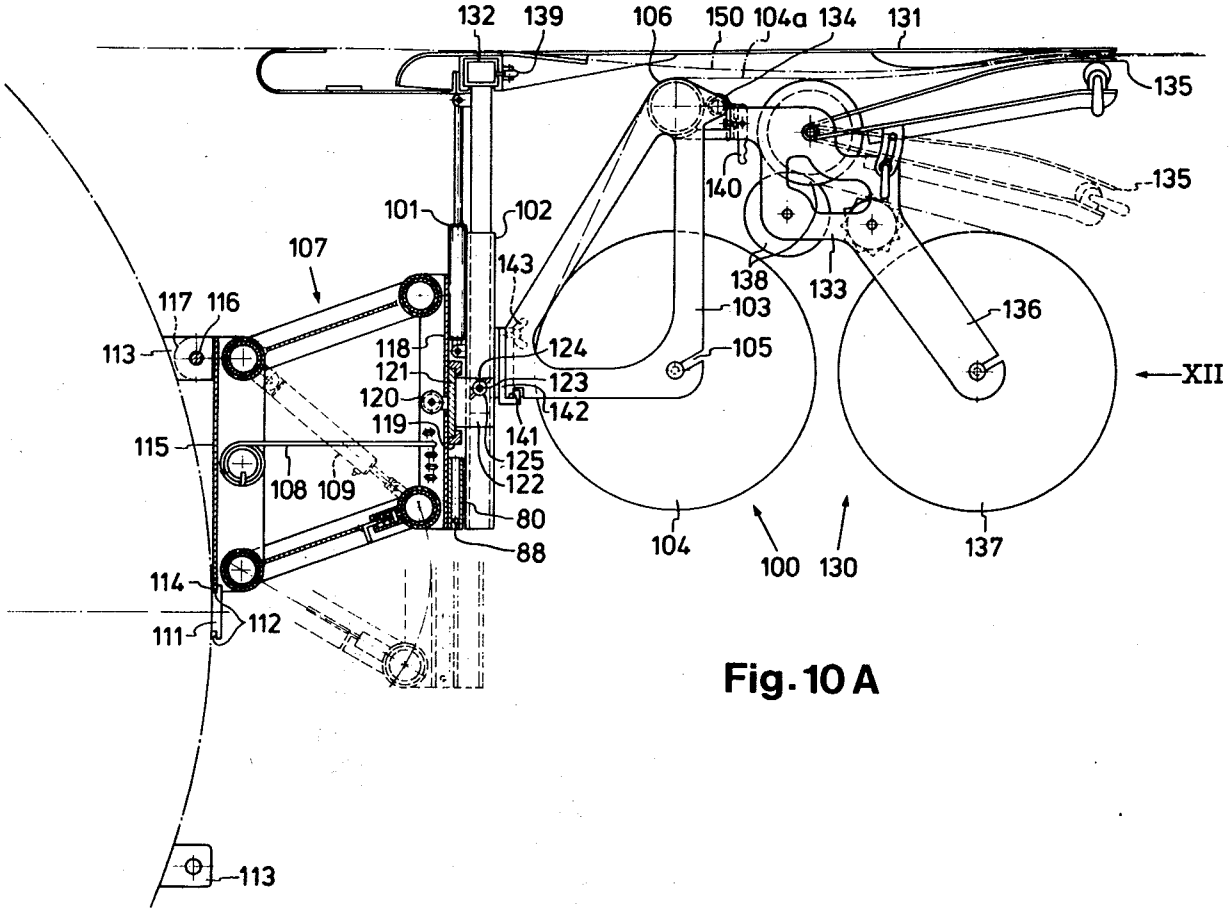
FIG. 10A is a fragmentary view on an enlarged scale and in part-sectional side elevation of an embodiment of applicator means and stapler means suitable for use in the embodiment of FIGS. 1 and 7 and mounted on the shield plate of the operative cutting cylinder and raised into its operative position against the roof.
Figure 10B:
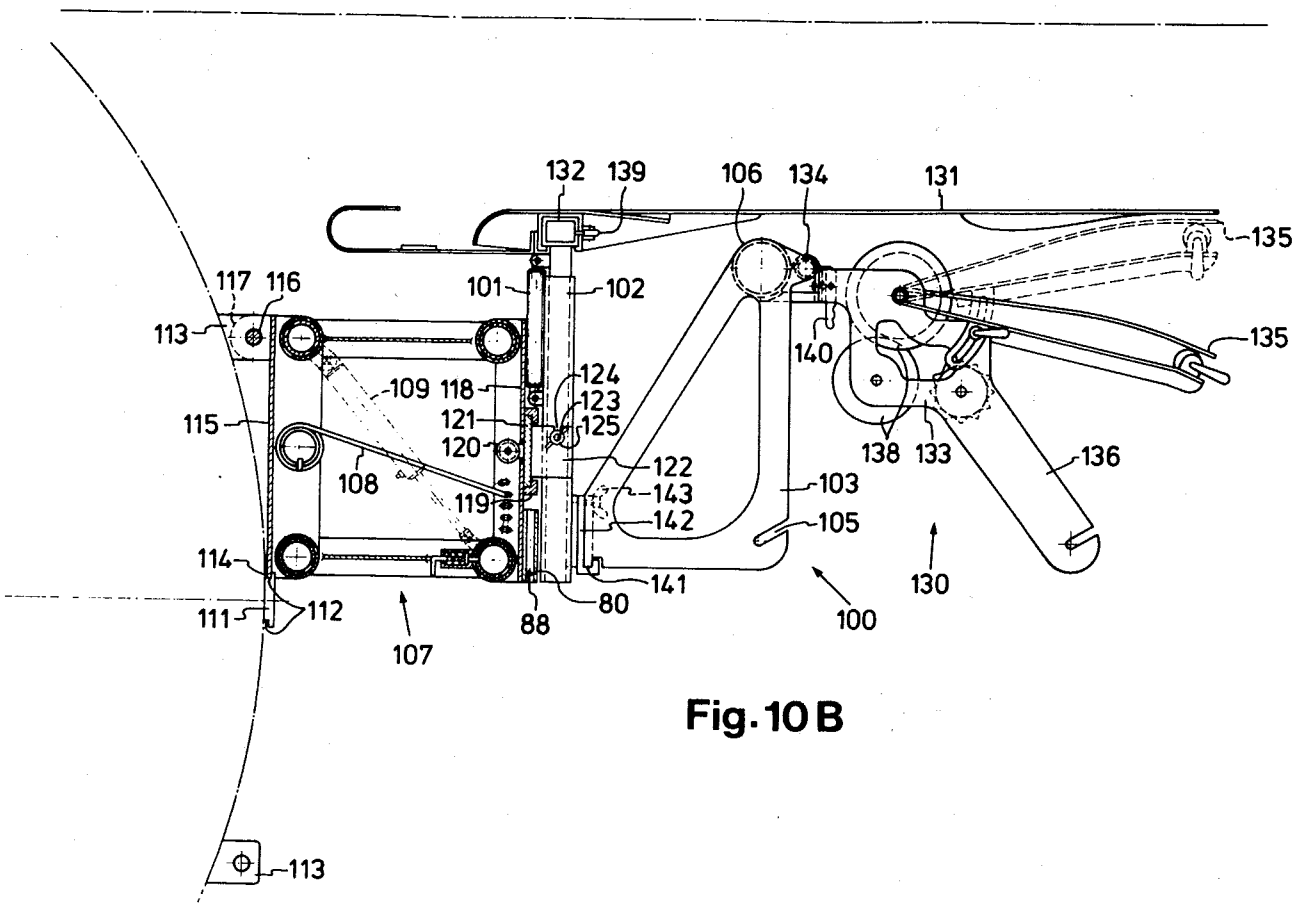
FIG. 10B shows the applicator and stapler means of FIG. 10A in a telescoped or collapsed position.
Figure 11:
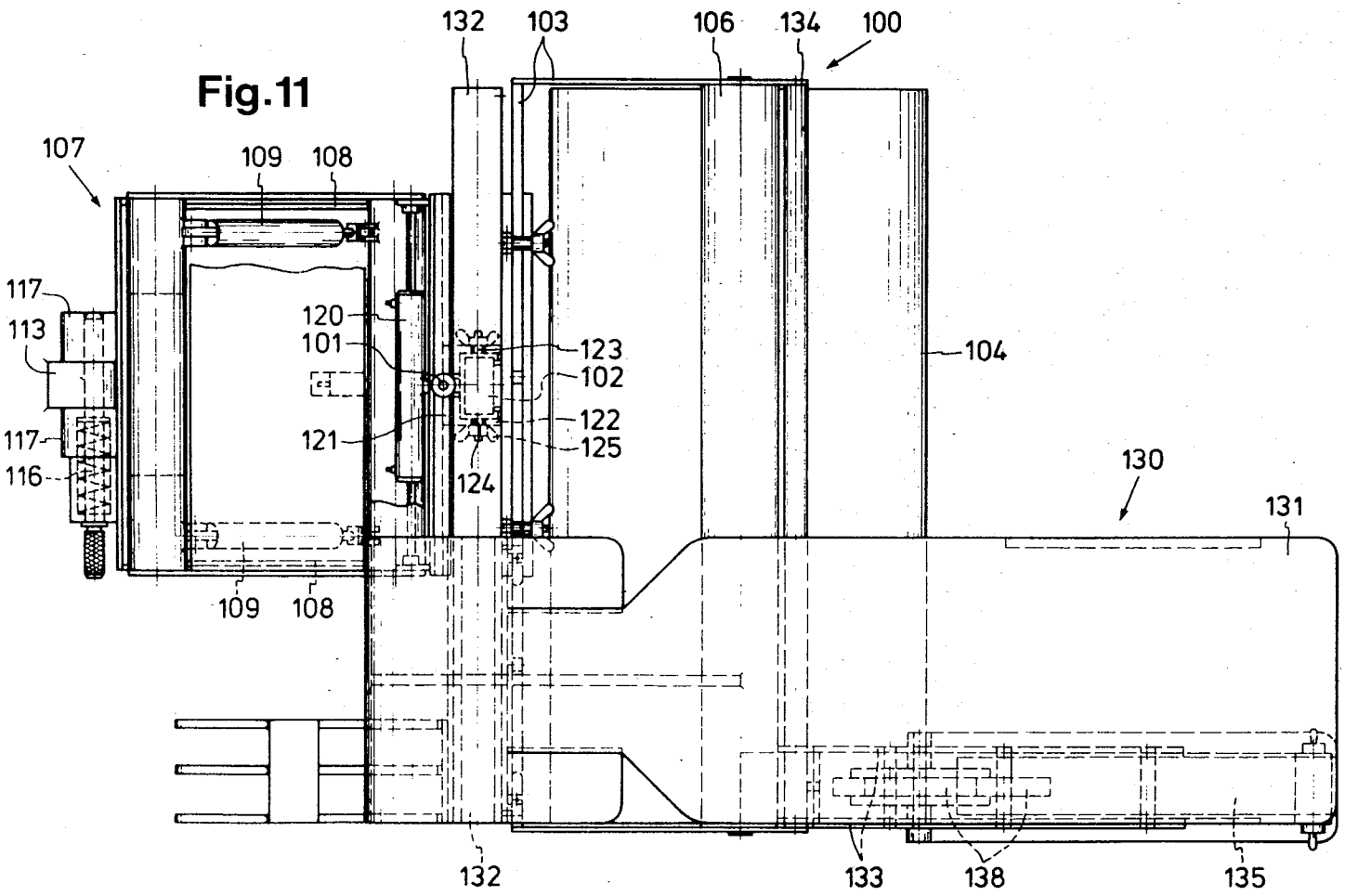
FIG. 11 is a plan view of the applicator and stapler means shown in FIG. 10A.
Figure 12:
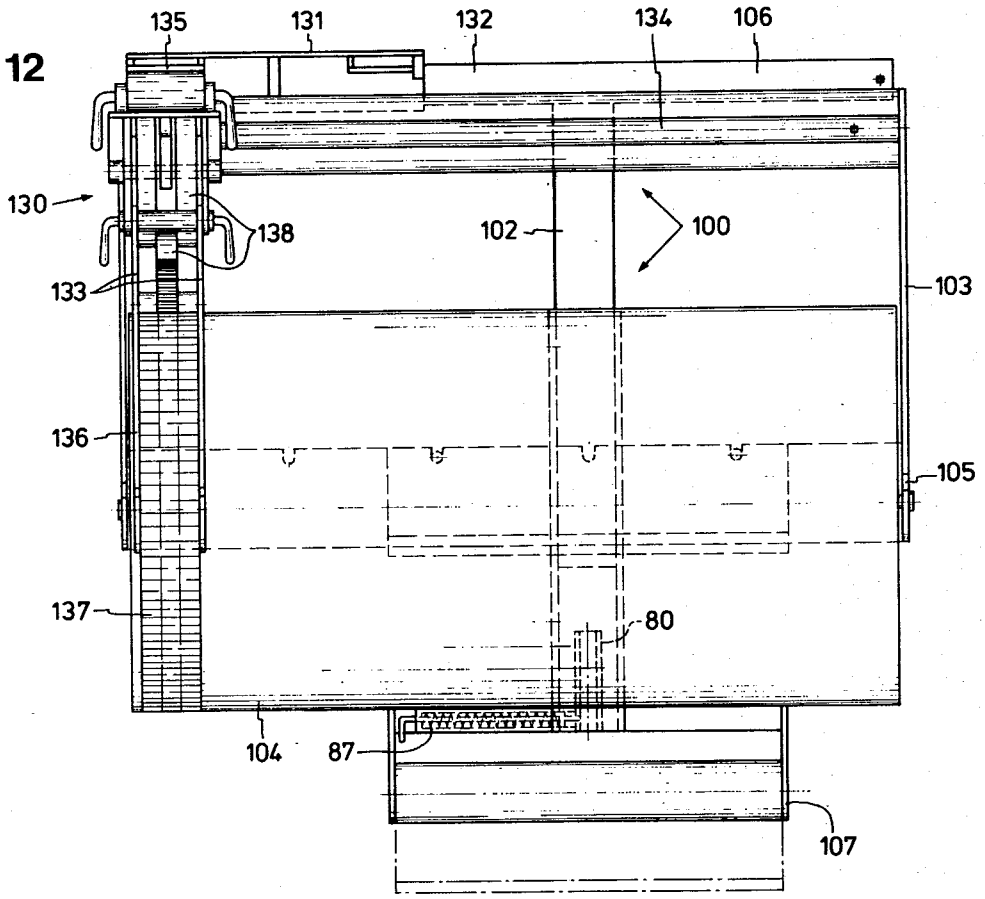
FIG. 12 is a fragmentary view in end elevation viewed in direction of arrow XII in FIG. 10A.

The applicator means 100 shown by way of example in FIGS. 10A, 10B and 11, which can be lifted off the shield plate and transferred to another place with the aid of the above described lifting means, may be of the general form disclosed in my U.S. Pat. No. 4,122,682 which is to be deemed to be included in the present disclosure. For convenience it is here noted that it may comprise a carrier frame or cradle 103 on a telescopic prop 102 which can be extended and retracted by means of an hydraulic cylinder 101. For accommodating a rolled up store of roof matting material 104 the cradle 103 has holder slots 105. A deflector member 106 is integrally joined to the carrier frame 103, to direct and steer the matting strip **104*a* as this is drawn off the matting roll 104**.

As an example of a connection between the applicator means 100, and the shield plate, the drawings show a rotationally rigid parallelogram 107 which is effective to raise the applicator means through springs 108 and/or a piston and cylinder unit 109. For releasable mounting of this linkage with the shield plate mounting means are provided. This comprises, on the shield plate, a mounting rail or strip 111 of a cross-sectional shape to provide groove 112 at each of its upper and lower edges in combination with the upper and lower halves of the shield plate. The mounting means further comprises a lug or fish plate 113 on each side of the shield plate and in equidistant positions above and below said rail or strip. The cooperative parts of the mounting means on the linkage 107 and which respectively cooperates with the upper groove 112 and the upper fish plate 113 on the shield plate are a backplate 115, whereof the bottom edge 114 is adapted to drop into groove 112, and a pair of lugs or fish plates 117 provided with a spring bolt 116.

A front plate 118 of the linkage 107 is provided with a horizontal guideway 119 along which a slide plate 121 carrying two lugs or fish plates 122, is slidable by means of an hydraulic cylinder 120. The telescopic prop 102 is received between these two straps; it has a laterally extending securing peg 123 which drops into open-topped slots 124 formed in the straps. This very easily detachable connection between the telescopic prop 102 and the linkage assembly can be further secured by screw clamps 125 or other suitable locking devices.

In the illustrated example the applicator means 100 is associated with a stapler means 130, which may be of the form described in my U.S. Pat. No. 4,122,682 which is to be deemed to be included in the present disclosure. In the present embodiment a special advantage is obtained due to the fact that the head or top of the telescopic prop 102 is modified to form a carrier bar 132 of hollow rectangular cross-section on which an upper pressing die 131 of the mat stapler means is laterally slidable, and is adapted to be locked in a given position and is manually detachable. The lower part 133 of the mat stapler means deriving support from the deflector bar 106 is mounted in a similar manner, i.e. horizontally slidable, and adapted to be locked in position and easily released with respect to a mounting bar 134, here shown of tubular form, and which itself is mounted parallel with the deflector bar 106 and forms a unit with the latter and the frame 103. The lower part 133 acts as a carrier for a further part 135 of the stapling means, which part 135 in raised position cooperates with the die 131. Also the lower part 133 acts as a carrier for the remaining parts of the stapling means comprising a supporting arm 136 for a roll of stapling strip material 137, and a pair of profiled dies or rolls 138. The stapling means operates to effect stapling of the matting strip 104*a* to the edge region of the previously laid matting strip 150 which projects forwardly of the leading edge of the roof support system and had been applied to the roof in the course of the preceding mat laying cycle.

To release the locking engagement of the upper stapler part 131 from the carrier bar 132 the locking plunger shown has a handle 139 whilst similarly a locking plunger for the lower part 133 is released from bar 134 by means of a handle 140. Manually releasable fasteners, e.g. screws, or also wing nuts 143, are also provided to secure the frame 103 in the groove of bar 142 whereby the frame is connected with the outer element of the telescopic prop 102.

With the aid of a rotational coupling, not shown in the drawing, which may be arranged adjacent to the locking plunger handle 140, for example, it would be possible to make the stapler means 130 including the stapler roll 137 and the lower part 133, 135 rotatable about an axis parallel to the direction of transport, and arrange for their immobilisation or locking in various angular positions thereof.

Due to the fact that the whole structure or construction of a mat applicator means, with or without a mat stapler means and carried on the shield plate or another part which is mounted to partake of height adjustment with the cutting cylinder axis, consists of and is subdivided into a plurality of individual units or parts which can be readily disconnected—in the illustrated example parts 135, 133, 103, 131, 102 and 107—it is possible to keep the weight of practically every one of these parts or units within limits which will not put an excessive strain on the strength of a single workman, or at any rate of a two-man team, if conditions are such as to necessitate manual installation setting up or adjusting the equipment, i.e. the lifting means should become inoperative due to difficult operating conditions at the coal face.

The lifting means may additionally or alternatively be adapted to handle individual parts or assemblies of the mining machine when these have to be removed for repair or replacement.

Thus the lifting means may be used for removing and replacing in the shield plate or cutter of the machine.

Auxiliary appliances which may require to be used from time to time or adjacent to the machine may also be handled by the lifting means such as hydraulic props, hydraulic piston and cylinder units, conveyor parts, or roof bars.

Figure 4A:
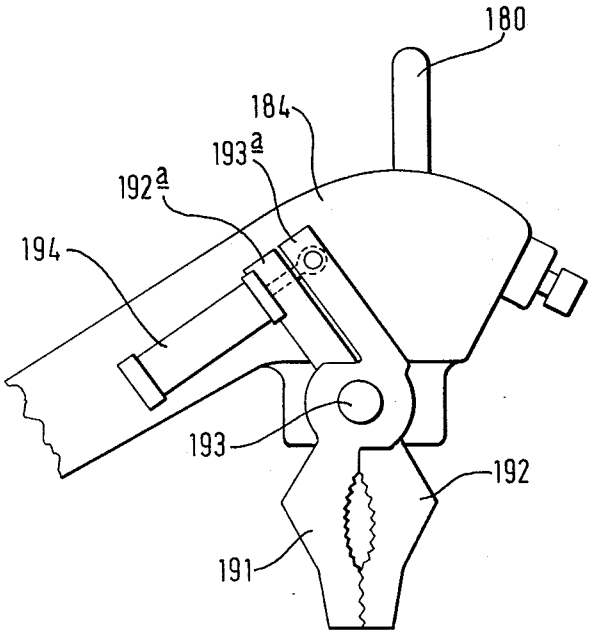
FIG. 4A is a fragmentary view on an enlarged scale showing one embodiment of headpiece equipped with gripping jaws for handling parts of the machine and ancilliary members as required.

For this purpose the jib arm as shown in FIG. 4A may be equipped at its free end with a head piece 184 including a coupling element 180 equivalent to that 80 already described and provided additionally or alternatively with clamping jaws or fingers 191, 192 pivoted on a pin 193 to form a scissor joint and operated by hydraulically energised piston and cylinder means such as a double-acting piston and cylinder unit 194 of which the cylinder is mounted on jaw extension 192*a* and the piston rod is pivotally connected to jaw extension 193*a*. Retention in a closed or other adjusted position may be effected hydraulically by valve means in the circuit supplying fluid to the unit 194. The jaws may be shaped as shown, or may be so constructed as to be of adjustable configuration to be able to grasp and release parts of a variety of shapes and sizes.

I claim:

1. In a mining machine comprising a body movable in forward and reverse directions of traverse along and adjacent to an upstanding face from which material is to be removed in a mining operation, a cutting element on said body for removing said material and thereby creating a succession of newly exposed elongate roof zones requiring support, and applicator means for applying strips of flexible roof mat, drawn off from a store, in respective positions such that said strips extend with their lengths running longitudinally of respective ones of said newly exposed roof zones, the improvement comprising the provision of a. mounting means for releasably mounting said applicator means in an operative position of use on said mining machine, said mounting means comprising cooperative releasable parts provided respectively on a part of the mining machine adjacent to and movable with said cutting element, and on said applicator means, b. transfer means for moving said applicator means between said position of use and a further position spaced from said position of use, and including lifting means engageable with the assembly of applicator means and that one of said releasable parts provided thereon to remove said assembly, support it, and move it to said further position and, c. coupling means including coupling elements respectively on said lifting means and on said assembly quickly engageable with and releasable from each other to facilitate transfer of said assembly between said positions.

2. Apparatus according to claim 1 wherein said further position is a position of rest spaced laterally of the direction of traverse of the machine and away from the face.

3. Apparatus according to claim 1 wherein said further position is an alternative position of use in which the applicator means is disposed behind and adjacent to a further cutting element during traverse of the machine in a direction reversely of that for which the first said position of use of the applicator means is appropriate.

4. Apparatus according to claim 1 wherein said further position is an alternative position of use in which the applicator means is disposed behind and adjacent to the same cutting element during traverse of the machine in a direction reversely of that for which the first said position of use of the applicator means is appropriate.

5. Apparatus according to claim 1 wherein said part associated with said cutting element is a shield plate.

6. Apparatus according to claim 1 wherein a. the part of the mounting means on the applicator means comprises a parallel link assembly providing for relative vertical movement between the applicator means and the cooperative part of the mounting means on the mining machine, b. biasing means is provided for urging the applicator means upwardly.

7. Apparatus according to claim 1 wherein said coupling elements are male and female coupling elements and wherein releasable retaining means are provided to lock or hold said assembly in a desired position against swivelling in a horizontal plane relatively to said lifting means.

8. Apparatus according to claim 1 wherein a. said lifting means comprises a jib arm, b. connecting means is provided on said machine for connecting said jib arm thereto and including swivelling means providing for horizontal swivelling of said jib arm.

9. Apparatus according to claim 8 wherein said connecting means also includes elevating means providing for angular movement of said jib arm in a vertical plane.

10. Apparatus according to claim 9 wherein said jib arm includes elements which are movable relatively to each other lengthwise of said jib arm to vary the effective length thereof.

11. In a mining machine comprising a body movable in forward and reverse directions of traverse along and adjacent to an upstanding face from which material is to be removed in a mining operation, a cutting element on said body for removing said material and thereby creating a succession of newly exposed elongate roof zones requiring support, and applicator means for applying strips of flexible roof mat, drawn off from a store, in respective positions such that said strips extend with their lengths running longitudinally of respective ones of said newly exposed roof zones, the improvement comprising a. means for releasably mounting said applicator means in an operative position of use on said mining machine, b. transfer means for moving said applicator means between said position of use and a further position spaced from said position of use, and wherein c. the mounting means includes means providing for positional adjustment of the applicator means in a lateral direction towards and away from the face, d. retaining means are provided for retaining the applicator means in any of a number of different positions.

12. Apparatus according to claim 7 wherein a. the means providing for said lateral adjustment comprises a vertically extensible prop, the upper end of which carries at least that part of the applicator means for applying the matting strip against the roof, b. the mounting means includes means defining a horizontal, laterally extending, guideway in which the lower end of said prop is carried.

13. In a mining machine comprising a body movable in forward and reverse directions of traverse along and adjacent to an upstanding face from which material is to be removed in a mining operation, a cutting element on said body for removing said material and thereby creating a succession of newly exposed elongate roof zones requiring support, and applicator means for applying strips of flexible roof mat, drawn off from a store, in respective positions such that said strips extend with their lengths running longitudinally of respective ones of said newly exposed roof zones, the improvement comprising a. means for releasably mounting said applicator means in an operative position of use on said mining machine, b. transfer means for moving said applicator means between said position of use and a further position spaced from said position of use, and wherein c. said machine includes guide means defining a path for translatory movement of said transfer means along said mining machine longitudinally of the direction of traverse of the mining machine, d. said transfer means comprises a base element mounted in said guide means to be movable therealong but constrained against tilting movement relatively to said guide means.

14. Apparatus according to claim 13 wherein said transfer means is operable by drive means and means is provided for retaining said transfer means in any of a plurality of adjusted positions for this purpose.

15. Apparatus according to claim 14 wherein at least certain of the drive means comprise worm and wormwheel gearing intrinsically providing for locking or retention in any of a plurality of positions of adjustment.

16. Apparatus according to claim 13 wherein at least certain of the drive means comprise pressure fluid energised actuating devices.

17. In a mining machine for use in long wall coal mine working and comprising a body, a cutting element supported from the body for removing coal from an upwardly extending face of said working as the machine is traversed therealong, the improvement comprising the provision on the machine of a. a lifting means for handling a movable member in the vicinity of said machine, said lifting means including means for releasably engaging and supporting said member, means for raising and lowering said member, and b. means for horizontally swivelling said lifting means.

18. A machine according to claim 17 wherein said machine includes guide means defining a path for translatory movement of said lifting means along said machine longitudinally of the direction of traverse of said machine, and said lifting means includes a base means mounted non-tiltably on and for movement along said guide means, and further includes a head means formed, constructed or provided with means for cooperating with the part or member to be handled.

19. In a mining machine comprising a body movable in forward and reverse directions of traverse along and adjacent to an upstanding face from which material is to be removed in a mining operation, a cutting element on said body for removing said material and thereby creating a succession of newly exposed elongate roof zones requiring support, and applicator means for applying strips of flexible roof mat, drawn off from a store, in respective positions such that said strips extend with their lengths running longitudinally of respective ones of said newly exposed roof zones, the improvement comprising a. means for releasably mounting said applicator means in an operative position of use on said mining machine, b. transfer means for moving said applicator means between said position of use and a further position spaced from said position of use, and c. biasing means for urging the applicator means upwardly, wherein d. the mounting means comprises releasable parts provided, respectively, on a part of the mining machine associated with the cutting element concerned, and on the applicator means, and e. the part of the mounting means on the applicator means comprises a parallel link assembly providing for relative vertical movement between the applicator means and the cooperative part of the mounting means on the mining machine.

* * * * *